United States Patent [19]

Leise et al.

[11] 4,344,612

[45] Aug. 17, 1982

[54] SHEET FEEDER SUPPORT ASSEMBLY

[75] Inventors: Walter F. Leise, Farmingville; John J. Darcy, Nesconset, both of N.Y.

[73] Assignee: Burroughs Corporation, Detroit, Mich.

[21] Appl. No.: 149,177

[22] Filed: May 12, 1980

[51] Int. Cl.[3] ..... B65H 1/00

[52] U.S. Cl. ..... 271/162; 243/359; 271/4; 400/680

[58] Field of Search ..... 271/162, 4; 400/680, 400/625, 624, 603.1; 248/359, 460, 646, 351; 49/345, 394; 217/60 R, 60 B, 60 C, 60 E, 60 G; 220/335; 312/319

[56] References Cited

U.S. PATENT DOCUMENTS

| | | | |
|---|---|---|---|
| 884,377 | 4/1903 | Francis et al. | 217/60 R |
| 2,216,445 | 10/1940 | McKinney | 217/60 E |
| 3,461,607 | 8/1969 | Sandow et al. | 49/394 X |
| 3,671,094 | 6/1972 | Turner et al. | 220/35 X |
| 4,147,341 | 4/1979 | Wurscher et al. | 271/4 X |

*Primary Examiner*—Bruce H. Stoner, Jr.
*Attorney, Agent, or Firm*—Mark T. Starr; Kevin R. Peterson; Edward J. Feeney, Jr.

[57] ABSTRACT

A sheet feeder support assembly is disclosed which is utilized to hold a sheet feeder in a raised position from its normal resting position on the printer without the requirement of any actual modifications to either the sheet feeder or the printer.

8 Claims, 4 Drawing Figures

SHEET FEEDER SUPPORT ASSEMBLY

BACKGROUND OF THE INVENTION

1. Field of the Invention

This invention relates to removable sheet feeders which are used in conjunction with printers.

2. Prior Art

In the past, sheet feeders were usually mounted to the printer on a pair of rails. It was initially positioned on the back rail and thereafter pivoted forward until it rested on the forward rail. In its normal operating position on this frame, operator access to the platen for a manual feed operation was almost impossible. To gain access to the platen area required the operator to pick up the entire sheet feeder unit and remove it from the printer and place it elsewhere for the period of time necessary to accomplish the manual feed operation. For example, such a manual feed operation was necessary for printing on odd paper sizes, index cards, envelopes and other paper elements which could not be machine fed. After completion of the manual feed operation, the operator would then pick up and remount the sheet feeder in its original position. The physical size, bulkiness and weight of the usual sheet feeder makes this an onerous and time-consuming task. In addition, during this period of exposure, the equipment is susceptable to damage.

BRIEF DESCRIPTION OF THE INVENTION

A. Objects of the Invention

Accordingly, it is an object of the invention to provide an improved sheet feeder support assembly.

Another object of the invention is to provide a sheet feeder support assembly which does not require the operator to pick up and remove the sheet feeder from the printer during a manual feed operation.

A further object of the invention is to provide a sheet feeder support assembly which allows the operator to pivot the sheet feeder out of the way without detaching it from the printer to thereby provide convenient access to the platen area.

Still a further object of the invention is to provide a sheet feeder support assembly which may be installed between the sheet feeder and the printer substantially without modifications to either the sheet feeder or the printer.

Another object of the invention is to provide a sheet feeder support assembly which when mounted between the printer and the sheet feeder is automatically activated by the raising of the forward end of the sheet feeder to pivotally engage and lock a support rod through the action of a torsion spring.

B. Summary of the Invention

In the preferred embodiment of the invention, a sheet feeder support assembly is proposed which comprises a support rod, a pivot locking latch, and a torsion spring. As the sheet feeder is raised in its forward end, the torsion spring activates the latch to pivotally lock the support rod beneath the sheet feeder. In this raised condition, manual feed operations may be easily performed beneath the sheet feeder since the platen area is readily accessible without completely removing the sheet feeder from the printer.

DESCRIPTION OF THE DRAWINGS

The foregoing objects and summary will be more readily understood from the following detailed description of the invention when read in conjunction with the accompanying drawings wherein corresponding reference characters denote the same members in which.

DETAILED DESCRIPTION OF THE INVENTION

Figure 1:
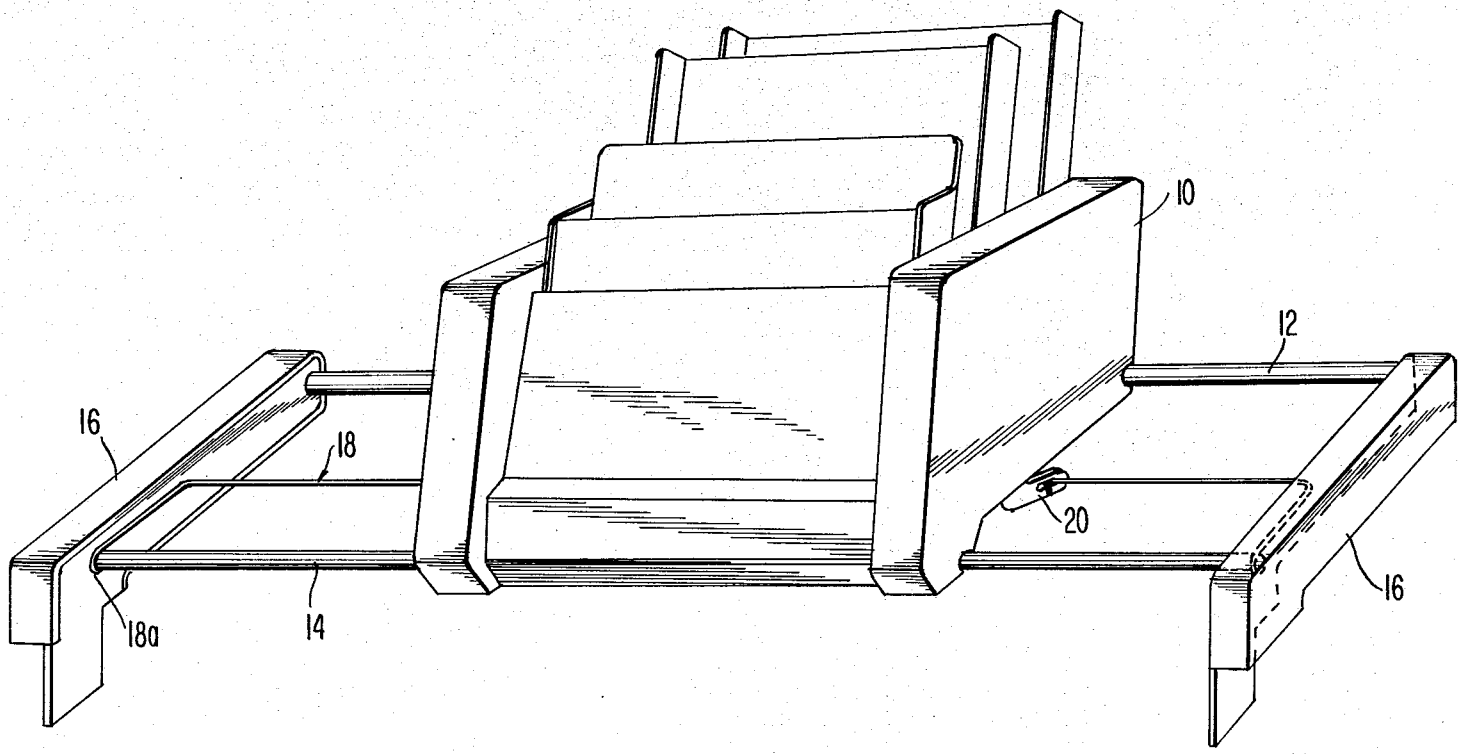
FIG. 1 is a perspective view showing the sheet feeder apparatus resting on the dual parallel rods of the sheet feeder mounting frame.

Looking first at FIG. 1, there is shown, in perspective, the sheet feeder 10 resting in its closed condition upon the dual rods 12 and 14 of the sheet feeder mounting frame 16, which is mounted to a printer apparatus. The support rod 18 is illustrated in general passing through the pivot locking latch 20.

The platen area of the printer apparatus is immediately beneath the sheet feeder 10 and is, for all practical purposes, inaccessible to the operator. As previously noted, for the operator to manually feed odd paper sizes to the platen area of the printer, it was required to completely remove and temporarily store the sheet feeder.

Figure 2:
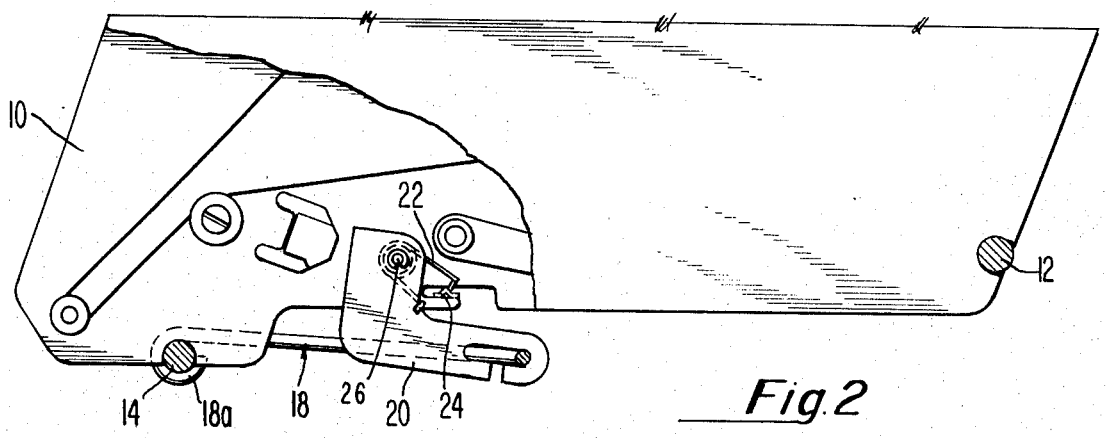
FIG. 2 is a side view of the sheet feeder with a cutaway portion illustrating the sheet feeder support mechanism in its lowered or closed position.

FIG. 2 illustrates in detail the support mechanism of the present invention in a closed (sheet feeder lowered) condition. A "U"-shaped support member 18 encircles, at each of its ends, the forward support rod 14. The proposed support member is a single piece of 0.156" diameter steel rod formed into a "U" shape with two looped ends **18*a* and 18*b* (18*b* not shown in FIG. 2 due to cutaway portion). In this closed condition, the support rod 18 folds beneath the sheet feeder by pivoting the locking latch 20 which thereby compresses the torsion spring 22** in a counter-clockwise direction.

Figure 3:
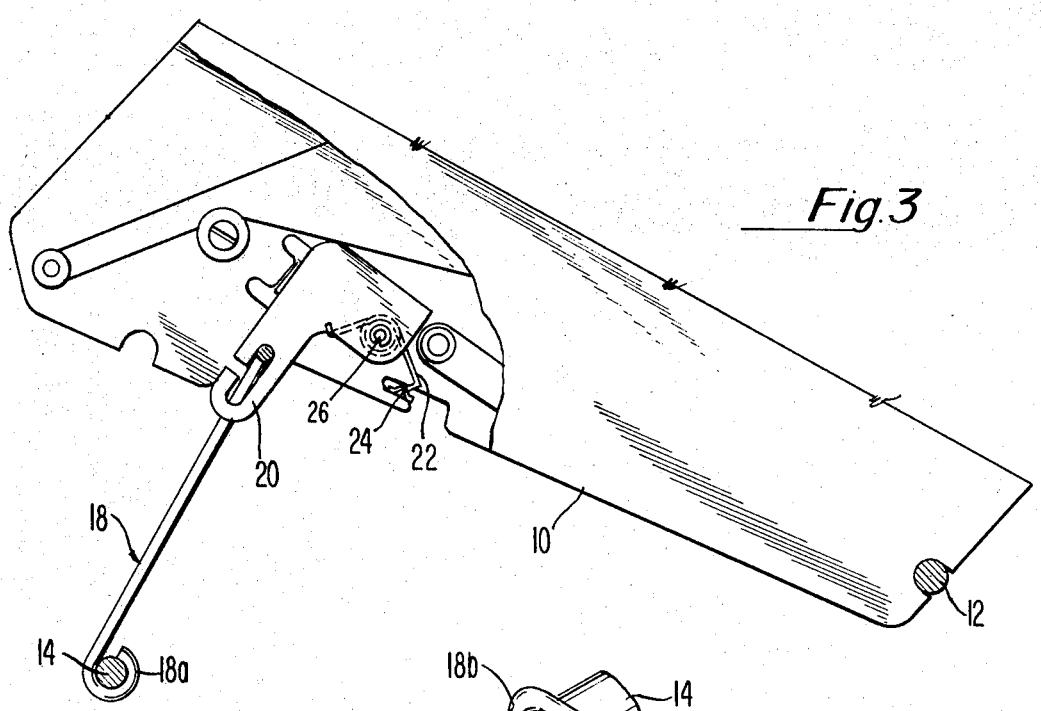
FIG. 3 is similarly a side view of the sheet feeder again with a cutaway portion illustrating the sheet feeder support mechanism in its raised or open position.

When the sheet feeder is raised (open position) to make the platen area accessible to the operator, the support mechanism operates as shown in FIG. 3. By lifting the forward portion of the sheet feeder 10, the feeder pivots on the rear bar 12 of the sheet feeder mounting frame 16. Concurrently, with this lifting action, the torsion spring 22 unwinds in a clockwise direction to cause a similar rotation of the pivot locking latch 20. The pivot locking latch 20 and the torsion spring 22 are mounted to an existing post 26 on the right hand side panel of the sheet feeder 10 and retained by an "E" ring. One leg of the spring 22 is hooked under the lower edge of the side plate and the other leg is locked over the end of the latch 20. The rod 18 is then placed into the grooved slot of the locking latch 20 and the installation is complete, having required no actual modification of either the sheet feeder 10 or the printer.

Figure 4:
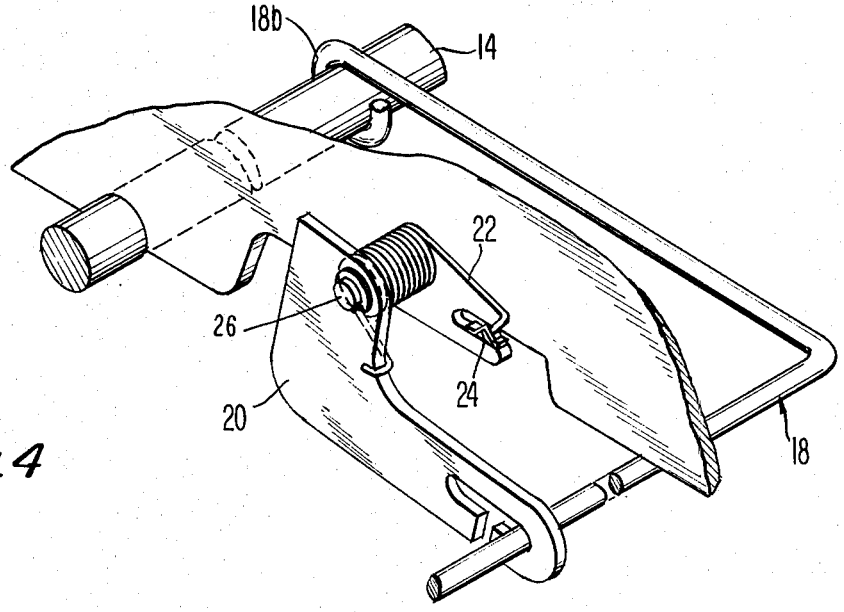
FIG. 4 is a detailed pictorial representation of the support mechanism.

FIG. 4 is a detailed pictorial diagram specifically of the area of the torsion spring 22 and the locking latch 20.

Conclusion

From the foregoing it is believed to be readily apparent that an improved sheet feeder support assembly has been provided. No longer is it necessary to completely remove and temporarily store the sheet feeder when the operator desires to perform a manual feed operation on the printer. In the present configuration, the operator need only raise the forward edge of the sheet feeder, the support mechanism will snap into position and the operator will have the platen area of the printer readily accessible so that a manual feed operation may be performed. When the manual feed operation is completed, the operator need only press down on the sheet feeder and the support mechanism will retract beneath the feeder, for future use during the next normal feed operation.

It will be understood from the foregoing that various changes may be made in the preferred embodiment illustrated herein and it is intended that the foregoing material be taken as illustrative only and not in a limiting sense, the scope of the invention only being defined as set forth in the following claims.

What is claimed is:

1. A sheet feeder support assembly for use between a sheet feeding apparatus and its mounting frame to a printing mechanism, said support assembly comprising:

a rigid support rod mounted on said mounting frame;

a locking latch member slidably connected to said support rod and pivotably connected to said sheet feeding apparatus to support said sheet feeding apparatus in a raised position; and a torsion spring mounted between said locking latch member and said sheet feeding apparatus, one end of said spring connected to said locking latch member, the other end of said spring connected to said sheet feeding apparatus such that a lifting motion on said sheet feeding apparatus enables said spring to pivot said locking latch member and, in turn, causes said support rod to supportably engage the sheet feeding apparatus in said raised position.

2. The sheet feeder support assembly as set forth in claim 1, wherein said support rod is a "U"-shaped rod loosely connected at each of its ends to the sheet feeder mounting frame.

3. The sheet feeder support assembly as set forth in claim 2 wherein said sheet feeder mounting frame includes a rear rod upon which the sheet feeder is pivotably mounted.

4. The sheet feeder support assembly as set forth in claim 3 wherein said sheet feeder mounting frame further includes a forward rod for supporting the forward end of said sheet feeding apparatus when said sheet feeding apparatus is in a lowered position.

5. The sheet feeder support assembly as set forth in claim 4 wherein said "U"-shaped rod is pivotably connected at both ends to said forward mounting rod of said sheet feeding mounting frame.

6. The sheet feeder support assembly as set forth in claim 1 wherein said support rod passes through and is slidably journeled in a slot in said locking latch member.

7. The sheet feeder support assembly as set forth in claim 6 wherein said locking latch member is generally el shaped, said slot in said locking latch member being located along the longitudinal axis and near the end of the longer section of said el shaped locking latch member.

8. A sheet feeder support assembly for use between a sheet feeding apparatus and its mounting frame to a printing mechanism, said sheet feeder support assembly comprising:

a "U"-shaped support rod rotatably mounted on a forward rod of said mounting frame;

a locking latch means pivotably mounted upon said sheet feeding apparatus and slidably connected to said "U"-shaped support rod; and a torsion spring means axially mounted on said sheet feeding apparatus, one end of said spring means connected to said locking latch means, the other end of said spring means connected to said sheet feeding apparatus, said spring means for providing pivotal rotation actuation of said locking latch means such that when the forward end of said sheet feeding apparatus is raised, the locking latch means is thereby actuated by said torsion spring means to engage said "U"-shaped support rod in a supporting position, wherein said support rod supports said sheet feeder in a forward raised position so that the printing mechanism is made accessible to an operator.

* * * * *